US010933658B2

(12) United States Patent
Morgan et al.

(10) Patent No.: US 10,933,658 B2
(45) Date of Patent: Mar. 2, 2021

(54) BAR CLAMP FOR MEDIA

(71) Applicant: Hewlett-Packard Development Company, L.P., Spring, TX (US)

(72) Inventors: Lonny Morgan, Vancouver, WA (US); Michael Allison, Vancouver, WA (US); Bruce G Johnson, Vancouver, WA (US); Robert Yraceburu, Vancouver, WA (US); Elliott Downing, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/332,070

(22) PCT Filed: Sep. 12, 2016

(86) PCT No.: PCT/US2016/051248
§ 371 (c)(1),
(2) Date: Mar. 11, 2019

(87) PCT Pub. No.: WO2018/048435
PCT Pub. Date: Mar. 15, 2018

(65) Prior Publication Data

US 2019/0366738 A1 Dec. 5, 2019

(51) Int. Cl.

| | |
|---|---|
| ***B41J 11/00*** | (2006.01) |
| ***B41J 13/10*** | (2006.01) |
| *B41J 13/22* | (2006.01) |
| *B65H 31/02* | (2006.01) |
| *B65H 31/34* | (2006.01) |

(52) U.S. Cl.
CPC ..... *B41J 11/0005* (2013.01); *B41J 13/106* (2013.01); *B41J 13/22* (2013.01); *B65H 31/02* (2013.01); *B65H 31/34* (2013.01); *B65H 2301/4212* (2013.01); *B65H 2402/342* (2013.01)

(58) Field of Classification Search
CPC ..... B41J 11/0005; B41J 13/106; B41J 13/24; B41J 13/32; B41J 13/10; B65H 2301/4212; B65H 2402/342; B65H 31/02; B65H 13/22
See application file for complete search history.

(56) References Cited

U.S. PATENT DOCUMENTS 4,340,213 A 7/1982 Jensen
5,745,141 A * 4/1998 Miyawaki ..... 347/104
(Continued)

FOREIGN PATENT DOCUMENTS

CN 1252356 5/2000
CN 1287649 3/2001
(Continued)

*Primary Examiner* — Juanita D Jackson
(74) *Attorney, Agent, or Firm* — HP Inc. Patent Department

(57) ABSTRACT

An example system includes a stacking portion having a leading edge portion and a trailing edge portion, the stacking portion being to receive print media transported into the stacking portion in a direction from the trailing edge portion to the leading edge portion; a bar clamp extending longitudinally in the direction of transport of the print media; and a driver arrangement to selectively extend the bar clamp onto the stacking portion and to retract the bar clamp away from the stacking portion.

13 Claims, 4 Drawing Sheets

(56) References Cited

U.S. PATENT DOCUMENTS

| | | | |
|---|---|---|---|
| 6,550,763 | B2 | 4/2003 | Gordon et al. |
| 7,954,939 | B2 | 6/2011 | Yamamoto et al. |
| 9,046,859 | B2 | 6/2015 | Koyanagi et al. |
| 9,132,666 | B2 | 9/2015 | Lo et al. |
| 9,272,872 | B2 | 3/2016 | Sugiyama et al. |
| 2003/0142191 | A1* | 7/2003 | Rasmussen et al. ..... 347/104 |

FOREIGN PATENT DOCUMENTS

| | | | |
|---|---|---|---|
| CN | 1455754 | | 11/2003 |
| CN | 102496206 | | 6/2012 |
| JP | 06032443 | | 4/1994 |
| JP | 2002274736 | | 9/2002 |
| JP | 2006103844 | A | 4/2006 |
| RU | 897105 | A | 1/1982 |

* cited by examiner

BAR CLAMP FOR MEDIA

BACKGROUND

Imaging systems, such as printers, generally include a stacking region for the collection of print media. The stacking region may be an output region where a user may receive the print media. In some examples, imaging systems may be provided with a finishing mechanism where the print media may be collected for post processing, such as stapling, three-hole punching, etc. In this regard, the stacking region may be within the imaging system where the print media are collected for post processing.

BRIEF DESCRIPTION OF THE DRAWINGS

For a more complete understanding of various examples, reference is now made to the following description taken in connection with the accompanying drawings in which.

DETAILED DESCRIPTION

Various examples provide for clamping of print media, such as a sheet, in a stacking region which may collect a stack of sheets. The clamping system reduces or eliminates curling of the edges of the sheets in the stack, as well as reducing air which may be trapped between the sheets. In various examples, a system may be provided. In various examples, a clamping system includes a bar clamp which extends substantially the length of the stacking region. In other examples, the bar clamp may extend only over a portion of the length, such as only a portion of the leading edge or a portion of the trailing edge. In some examples, the bar clamp extends over the trailing half, trailing third, trailing quarter or another selected portion. In this regard, the bar clamp extends from the trailing edge portion to the leading edge portion of the stacking region. In one example, the bar clamp is coupled to two arms, a driven arm and a passive (follower) arm. The driven arm is driven by, for example, a motor to selectively extend the bar clamp to the stack or to retract the bar clamp away from the stack. Various examples of the passive arm include a lost motion mechanism which may include a biasing component to bias the follower arm downward. Thus, the portion of the bar clamp connected to the passive arm (the trailing edge) makes contact with the stack before the portion connected to the driven arm (leading edge).

As described above, in some examples, print media may be collected for post processing, such as stapling, three-hole punching. In some cases, such as in inkjet printers where the ink may not be fully dried during stacking, alignment of sheets in a stack may become difficult. For example, the inkjet output sheets may be distorted from curl forming on the edges. Further, due to the moisture content, the sheets may also have reduced stiffness in addition to the curl, and high ink density regions may result in increased friction with adjacent sheets. The friction can result in misalignment with other sheets in the stack. Additionally, curling of the sheets can result in trapped air between the sheets. The trapped air can result in a variety of issues, such as an artificial increase in stack height.

Accordingly, the present disclosure describes example systems and methods to facilitate alignment of sheets in a stack. Various examples described herein provide clamping of sheets in a stacking region to facilitate the alignment and reduction or elimination of deformation, such as curling.

Figure 1:
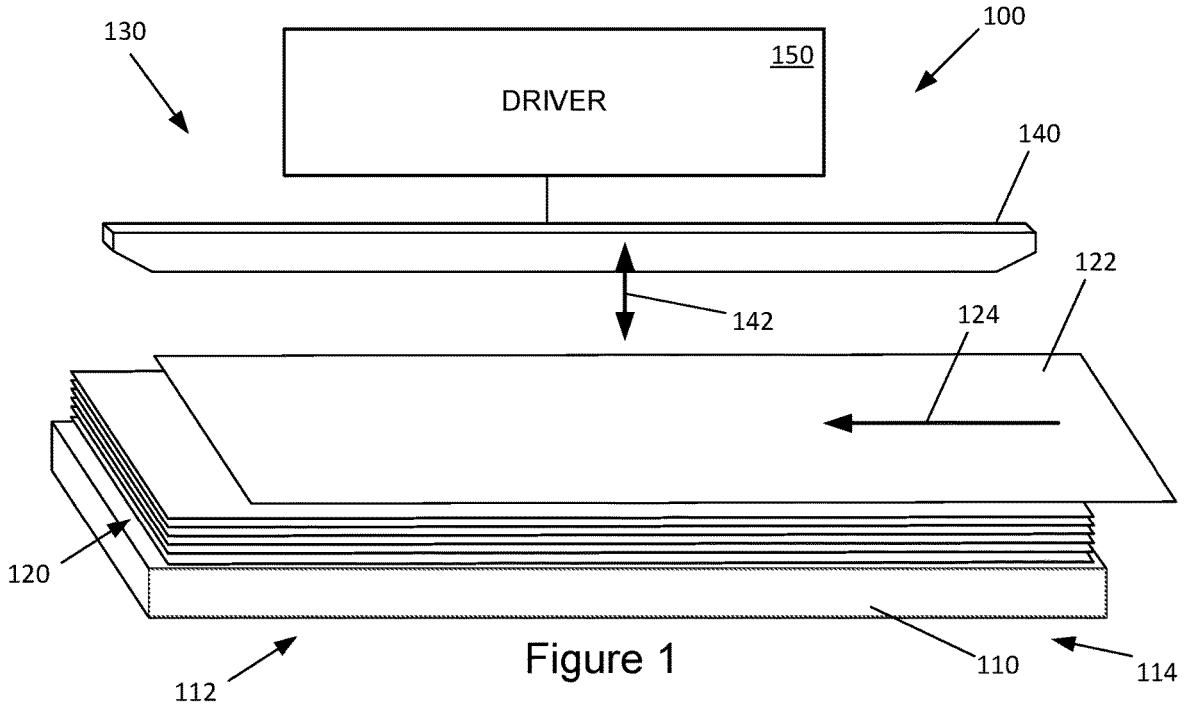
FIG. 1 is an illustration of an example system for media clamping.

Referring now to the figures, FIG. 1 illustrates an example system for media clamping. The example system 100 may be implemented in a variety of imaging devices, such as printers or copiers, for example. In some examples, the example system 100 of FIG. 1 is implemented in a finishing portion of an imaging device. The example system 100 includes a stacking portion 110 which may be a platform or a tray for stacking of print media. For example, FIG. 1 illustrates the example system 100 with a stack 120 of print media on the stacking portion 110.

Further, the stacking portion 110 may receive a print medium 122 transported onto the stacking portion 110 and/or the stack 120. In this regard, the example system 100 may further include an advancement mechanism (not shown) to transport the print medium 122 into the stacking portion 110. In various examples, the advancement mechanism may include rollers and/or puller clamps which translate to move the print media from an output of an imaging portion, for example, into the stacking region.

In the example illustrated in FIG. 1, the print medium 122 is transported in the direction indicated by the arrow 124. As used herein, the portion of the stacking portion 110 on which the leading edge of the print medium 122 rests (to the left of FIG. 1) is referred to as the leading edge portion 112. Similarly, the portion of the stacking portion 110 on which the trailing edge of the print medium 122 rests (to the right of FIG. 1) is referred to as the trailing edge portion 114. The leading edge portion 112 and the trailing edge portion 114 may refer to a region on the corresponding side. In this regard, the leading edge portion 112 and the trailing edge portion 114 are not limited to the corresponding edges.

The example system 100 of FIG. 1 further includes a clamping mechanism 130. The clamping mechanism 130 of the example system 100 is provided to facilitate alignment of the incoming print medium 122 with other media that may be in the stacking region, such as the stack 120. In this regard, the clamping mechanism 130 is provided with various features which function to reduce, minimize or eliminate the issues describe above, such as curling and trapping of air.

The clamping mechanism 130 of the example system 100 is provided with a bar clamp 140 extending longitudinally in the stacking region formed by the stacking portion 110. In this regard, the bar clamp 140 extends in the direction of transport 124 of the incoming print medium 122. In one example, the bar clamp 140 extends from the leading edge portion 112 of the stacking portion 110 to the trailing edge portion 114 of the stacking portion 110. In various examples, the length of the bar clamp 140 may be selected as desired. For example, in one example, the bar clamp 140 extends substantially the entire length of the stacking portion 110. In other examples, the bar clamp 140 extends above only a portion of the stacking portion 110.

The clamping mechanism 130 of the example system 100 of FIG. 1 further includes a driver 150 to selectively extend the bar clamp onto the stacking portion and to retract the bar clamp away from the stacking portion, as indicated by the double-ended arrow 142 in FIG. 1. In various examples, the driver 150 may include a motor and/or gearing mechanism. The driver 150 may be coupled to the bar clamp 140 in a variety of manners, such as arms which may be extended or retracted by actuation of the motor.

Figure 2:
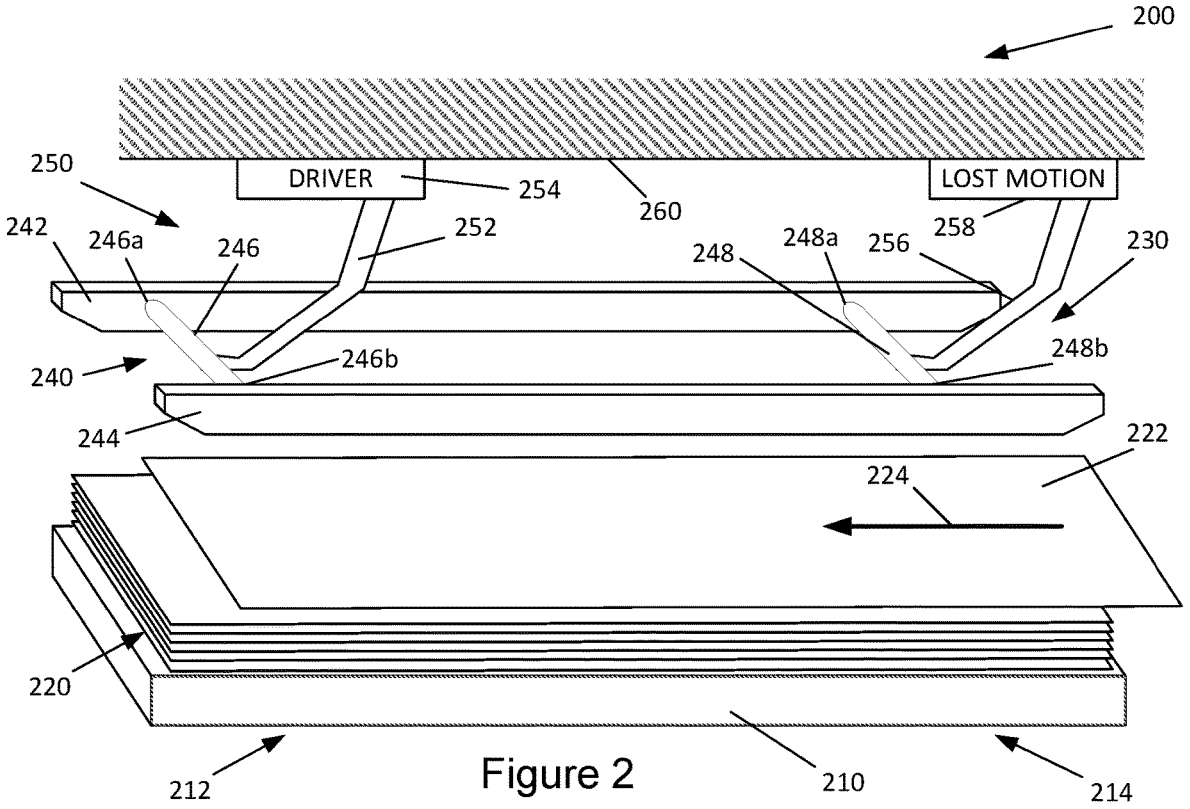
FIG. 2 is a perspective illustration of an example clamping system.

Referring now to FIG. 2, an example clamping system 200 is illustrated in a perspective view. The example clamping system 200 of FIG. 2 includes a platform 210 for accommodating a stack 220 of print media, such as sheets of paper. In this regard, the platform 210 forms a stacking region for the print media. In the example of FIG. 2, an incoming print medium 222 is transported into the stacking region and is transported onto the platform 210 in the direction indicated by the arrow 224. Accordingly, the stacking region formed by the platform 210 includes a leading edge portion 212 on which the leading edge of the transported print medium 222 rests when stacked. Similarly, the platform 210 includes a trailing edge portion 214 on which the trailing edge of the transported print medium 222 rests when stacked. Thus, the trailing edge portion 214 is referred to herein as being upstream of the leading edge portion 212, and the leading edge portion 212 is referred to herein as being downstream of the trailing edge portion 214.

The example clamping system 200 of FIG. 2 may include an advancement mechanism (not shown in FIG. 2) to facilitate transport of the incoming print medium 222 into the stacking region. The advancement mechanism may be a puller clamp which may engage a leading edge of the print medium 222 as the print medium is delivered into the stacking region of the platform 210 from, for example, an image forming portion (not shown). The puller clamp may then translate in the direction of the arrow 224, thus transporting the print medium 222 onto the platform 210 or the stack 220.

The example clamping system 200 of FIG. 2 includes a clamping mechanism 230 to secure the incoming print medium 222 and/or the stack 220 to, for example, reduce or eliminate curling or trapped air between sheets of the stack 220. In this regard, the clamping mechanism 230 includes a bar clamp arrangement 240 and a driver arrangement 250 to selectively extend and retract the bar clamp arrangement 240.

The bar clamp arrangement 240 of FIG. 2 includes a first bar clamp 242 and a second bar clamp 244 positioned parallel to each other. Each bar clamp 242, 244 extends longitudinally in the stacking region formed by the stacking portion 210. In this regard, each bar clamp 242, 244 extends in the direction of transport 224 of the incoming print medium 222. Similar to the bar clamp 140 described above with reference to FIG. 1, each bar clamp 242, 244 extends from the leading edge portion 212 of the stacking portion 210 to the trailing edge portion 214 of the stacking portion 210. In various examples, the length of each bar clamp 242, 244 may be selected as desired.

In the example of FIG. 2, the first bar clamp 242 and the second bar clamp 244 are positioned on opposing sides of the stacking portion 210. For example, viewed in the direction of transport 224 of the incoming media 222, the first bar clamp 242 is positioned on the right side of the stacking portion 210, and the second bar clamp 244 is positioned on the left side of the stacking portion 210. In various examples, the first bar clamp 242 and the second bar clamp 244 are positioned proximate to the edges of the stack 220 of print media. The distance from the edges of the stack for positioning of the bar clamps 242, 244 may be selected as desired. In various examples, the position of the bar clamps 242, 244 relative to the width of the stack 220 (orthogonal to the direction of transport of the print medium 224) may be fixed. In other examples, the position may be of the bar clamps 242, 244 in the orthogonal direction may be adjustable to accommodate different widths of print media.

The first bar clamp 242 and the second bar clamp 244 are connected to each other via a first cross bar 246 and a second cross bar 248. In this regard, the first cross bar 246 is coupled to the first bar clamp 242 at a first portion 246*a* of the first bar clamp 242 and coupled to the second bar clamp 244 at a first portion 246*b* of the second bar clamp 244. Similarly, the second cross bar 248 is coupled to the first bar clamp 242 at a second portion 248*a* of the first bar clamp 242 and coupled to the second bar clamp 244 at a second portion 248*b* of the second bar clamp 244.

As noted above, the driver arrangement 250 is provided to selectively extend and retract the bar clamp arrangement 240. In the example of FIG. 2, the driver arrangement 250 includes a first arm 252 and a second arm 256. The first arm 252 (or the driven arm) is coupled to the bar clamps 242, 244 through the first cross bar 246. Thus, the first arm 252 is coupled to the bar clamps 242, 244 at the respective first portion 246*a*, 246*b* of each bar clamp 242, 244.

Similarly, the second arm 256 is coupled to the bar clamps 242, 244 through the second cross bar 248. Thus, the second arm 256 is coupled to the bar clamps 242, 244 at the respective second portion 248*a*, 248*b* of each bar clamp 242, 244.

In the example of FIG. 2, the first arm 252 is coupled to a driver 254 that is affixed to a frame 260. The frame 260 may be, for example, the frame of an image forming system or a component thereof. As with the driver 150 described above with reference to FIG. 1, the driver 254 of FIG. 2 may include a motor and/or gearing mechanism. The driver 254 may be actuated to rotate to pivot the first arm 252 in either a clockwise or counterclockwise direction.

Unlike the first arm 252, the second arm 256 is not driven. Instead, the second arm 256 substantially follows the movement of the first arm 252. Thus, as the driver 254 drives the first arm 252, the bar clamp arrangement 240 is either extended (downward in FIG. 2) toward the stacking portion 210 or retracted (upward in FIG. 2) away from the stacking portion 210. The movement of the bar clamp arrangement 240 causes a corresponding movement of the second arm 256 which substantially follows the movement of the first arm 252. In this regard, the second arm 256 may be referred to as a follower arm or a passive arm.

In the example of FIG. 2, the second arm 256 is coupled to the frame 260 through a lost motion arrangement 258. As described in greater detail below with reference to FIGS. 3-5, the lost motion arrangement 258 may be provided to facilitate positioning of the length of the bar clamps 242, 244 onto the stacking portion 210 or the stack 220. In various examples, an additional lost motion arrangements may be provided between the first bar clamp 242 and the second bar clamp 244. For example, a lost motion arrangement may be provided at the first portion 246*a* and the second portion 248*a* of the first bar clamp 242.

In one example, the lost motion arrangement 258 biases the second arm 256 downward. Further, in the example illustrated in FIG. 2, the first arm (the driven arm) is positioned downstream of the second arm (the follower or passive arm). Thus, the bar clamps 242, 244 are lower on the trailing edge portion 214 of the stacking portion 210 than on the leading edge portion 212 of the stacking portion 210. Accordingly, when extended, the bar clamp arrangement 240 contacts the trailing edge portion 214 before it contacts the leading edge portion 212.

Figure 3:
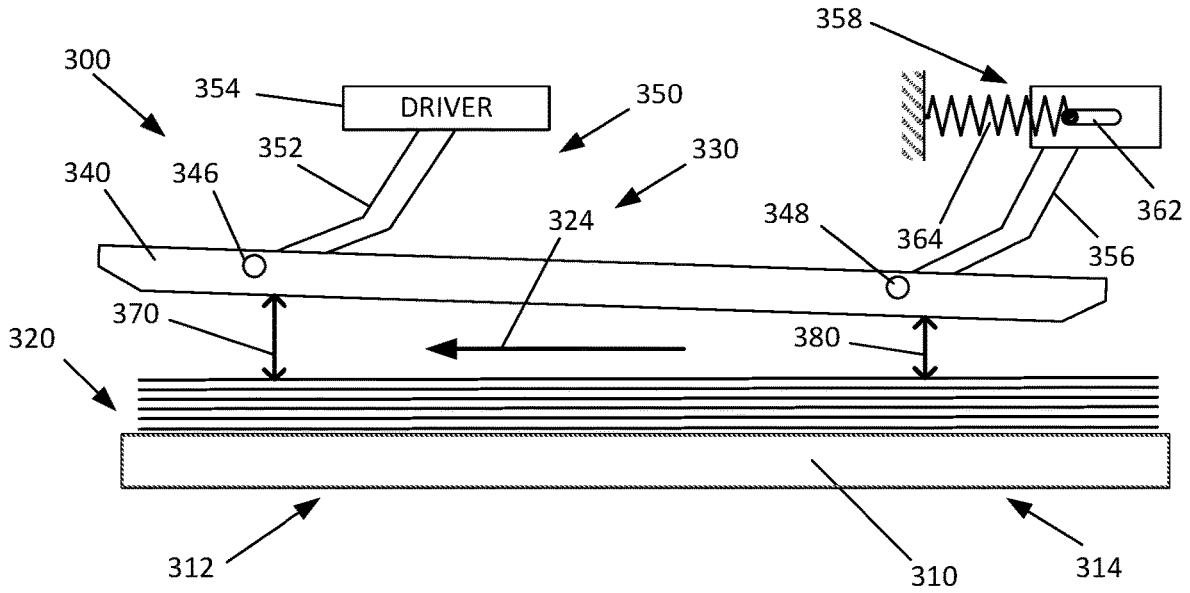
FIG. 3 is a side view of an example clamping system with a bar clamp in a retracted position.
Figure 4:
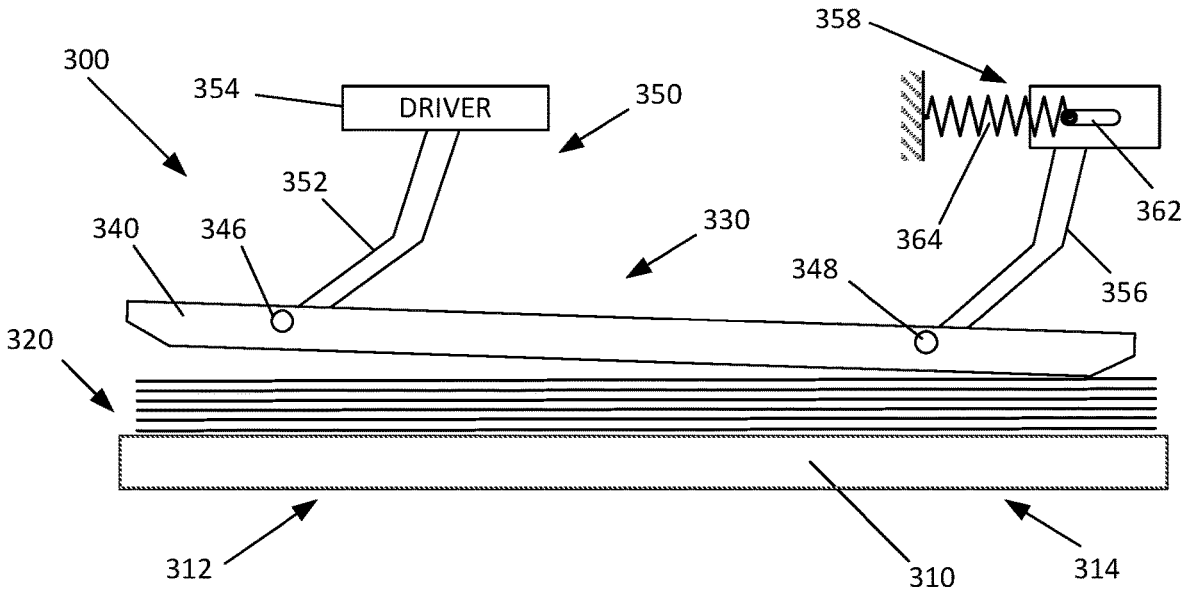
FIG. 4 is a side view of the example clamping system of FIG. 3 with the bar clamp in a partially extended position.
Figure 5:
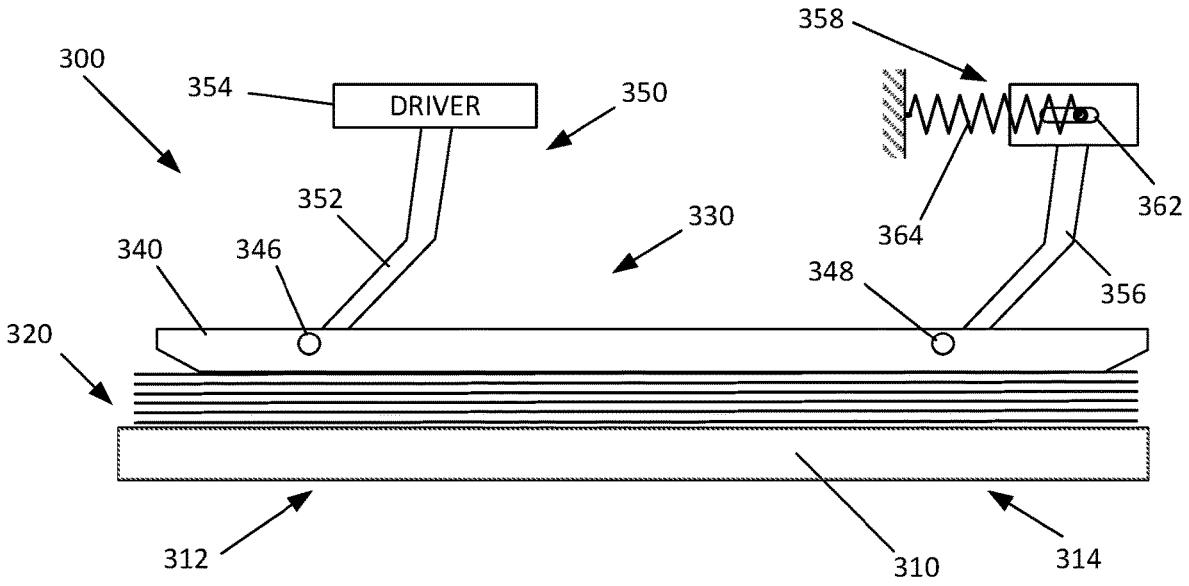
FIG. 5 is a side view of the example clamping system of FIG. 3 with the bar clamp in a fully extended position.

Referring now to FIGS. 3-5, side views of an example clamping system 300 are provided to illustrate an example operation of a clamping system 300 with bar clamps. Referring first to FIG. 3, the example clamping system 300 is illustrated with a stack 320 of sheets of print media on a platform 310. Print media may be transported onto the platform 310 or the stack 320 in the direction indicated by the arrow 324. The platform 310 includes a leading edge portion 312 on which the leading edge of the transported print medium rests when stacked and a trailing edge portion 314 on which the trailing edge of the transported print medium rests when stacked.

Similar to the example system 200 of FIG. 2, the example clamping system 300 of FIG. 3 includes a clamping mechanism 330 to secure the stack 320 to, for example, reduce or eliminate curling or trapped air between sheets of the stack 320. In this regard, the clamping mechanism 330 includes a bar clamp 340 and a driver arrangement 350 to selectively extend and retract the bar clamp arrangement 340.

The example of FIG. 3 is shown with a single bar clamp 340. As noted above with reference to FIG. 2, various examples may include two or more bar clamps positioned substantially parallel to each other. The bar clamp 340 extends longitudinally in the stacking region formed by the stacking portion 310 and extends in the direction of transport 324 of incoming print media (not shown).

The driver arrangement 350 includes a first arm 352 and a second arm 356. The first arm 352 is coupled to the bar clamp 340 at a first portion 346 of the bar clamp 340. Similarly, the second arm 356 is coupled to the bar clamp 340 at a second portion 348 of the bar clamp 340.

In the example of FIG. 3, the first arm 352 is coupled to a driver 354 that may include a motor and/or gearing mechanism. The driver 354 may be actuated to rotate to pivot the first arm 352 in either a clockwise or counterclockwise direction.

The second arm 356 is not driven and substantially follows the movement of the first arm 352. As described above, as the driver 354 drives the first arm 352, the bar clamp 340 is either extended or retracted. The movement of the bar clamp 340 causes a corresponding movement of the second arm 356 which substantially follows the movement of the first arm 352.

In the example of FIG. 3, the second arm 356 is coupled to a lost motion arrangement 358. In the example of FIG. 3, the lost motion arrangement 358 includes a sliding coupler 362 at which the second arm 356 is coupled to the lost motion arrangement 358. The sliding coupler 362 provides a limited range of movement for the second arm.

The example lost motion arrangement 358 of FIG. 3 further includes a resilient member 364. In various examples, the resilient member 364 may be a compression spring. The resilient member 364 biases the second arm 356 to be positioned at one end of the sliding coupler 362. Thus, the second arm 356 is in a more extended position than the first arm 352. As a result the bar clamp 340 is more retracted on the leading edge portion 312 than at the trailing edge portion 314. As illustrated in FIG. 3, the distance 370 at the leading edge portion 312 between the stack 320 and the bar clamp 340 is greater than the distance 380 at the trailing edge portion 314.

In the example of FIG. 3, the example clamping system 300 is illustrated with the bar clamp 340 in a retracted position. In this position, the system 300 may receive incoming print media onto the platform 310 or stack 320. Once the incoming media has been completely transported onto the platform 310 or the stack 320, the driver arrangement 350 may be actuated to extend the bar clamp 340. Referring now to FIG. 4, the example clamping system 300 is illustrated with the bar clamp partially extended.

As noted above, the lost motion arrangement 358 includes a resilient member 364 which biases the second arm 356 and positions the bar clamp 340 in a more extended position at the trailing edge portion 314. Thus, as illustrated in FIG. 4, as the driver arrangement 350 is actuated and the bar clamp 340 is extended, the trailing edge portion of the bar clamp 340 makes contact with the stack 320 first. In the position illustrated in FIG. 4, the bar clamp 340 has initially made contact with the stack 320.

Referring now to FIG. 5, as the driver arrangement 350 continues to drive the bar clamp 340, the bar clamp 340 comes into full contact with the stack 320. In this regard, the bar clamp 340 is fully engaged with the stack 320. For example, the entire length of the bar clamp 340 may be in contact with the stack 320.

In moving from the position in FIG. 4 to the position in FIG. 5, the lost motion arrangement 358 absorbs the difference in movement of the bar clamp 340 at the two ends of the bar clamp 340. In this regard, the resilient member 364 absorbs the excess energy, and the second arm 356 becomes positioned towards or closer to the opposite end of the sliding coupler 362. The lost motion arrangement 358 ensures that both ends of the bar clamp are down in cases, such as when the leading edge of the stack or the trailing edge of the stack are thicker or taller due to curl, media swelling.

Figure 6:
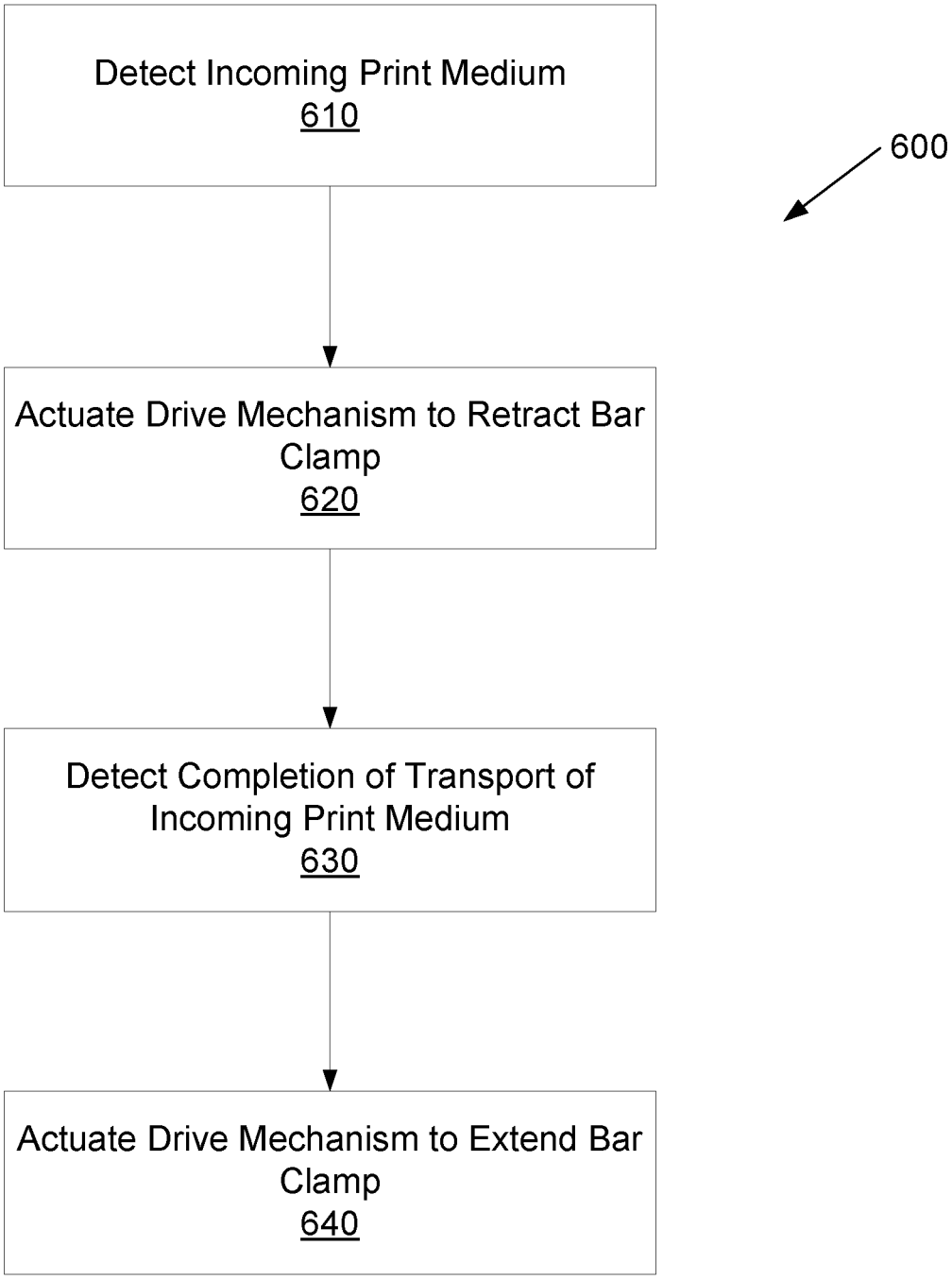
FIG. 6 is a flow chart illustrating an example process for media clamping.

Referring now to FIG. 6, a flow chart illustrates an example method for clamping of print media. The example method 600 of FIG. 6 may be implemented in a variety of manners, such as in the example systems 100, 200, 300 described above with reference to FIGS. 1-5. The example method 600 includes detecting an incoming print medium being transported to a stacking portion (block 610). For example, a sensor may be provided to detect an incoming print medium which may be transported from an image forming portion, for example.

In response to the detected incoming print medium, a drive mechanism may be actuated to retract a bar clamp (block 620). For example, as illustrated in FIG. 3, a driver arrangement 350 may be coupled to a bar clamp 340. As illustrated in FIG. 3, the bar clamp 340 extends in a longitudinal direction parallel to a direction of transport of the incoming print medium. When an incoming print medium is detected, the driver arrangement 350 may retract the bar clamp 340 away from the platform 320 to the position shown in FIG. 3. In this position, an incoming print medium may be allowed to enter the stacking region without interference.

The method 600 further includes detecting completion of transport of the incoming print medium to the stacking portion (630). The drive mechanism may then be actuated to extend the bar clamp onto the stacking portion (block 640). For example, as illustrated in FIGS. 4 and 5, the bar clamp 340 may be driven by the driver arrangement 350 into an extended position.

Thus, in accordance with various examples described herein, clamping of print media may be used to facilitate alignment of the media in a stack. The clamping may include extending a bar clamp that extends longitudinally in the direction of transport of incoming media.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. A system to stack print media, comprising:

a stacking portion having a leading edge portion and a trailing edge portion, the stacking portion being to receive print media transported into the stacking portion in a direction from the trailing edge portion to the leading edge portion;

a bar clamp extending longitudinally in the direction of transport of the print media; and a driver arrangement to selectively extend the bar clamp toward the stacking portion and to retract the bar clamp away from the stacking portion, wherein the driver arrangement comprises:

a driven arm coupled to a first portion of the bar clamp;

a passive arm coupled to a second portion of the bar clamp; and a driver to drive the driven arm in a first direction to extend the bar clamp and in a second direction to retract the bar clamp, the passive arm to follow movement of the driven arm through movement of the bar clamp.

2. The system of claim 1, wherein the bar clamp extends substantially from the leading edge portion to substantially the trailing edge portion.

3. The system of claim 1, wherein the first portion of the bar clamp is downstream of the second portion.

4. The system of claim 3, comprising:

a lost motion arrangement coupled to the passive arm, the lost motion arrangement biasing the passive arm in the first direction.

5. The system of claim 4, wherein the lost motion arrangement is to cause the bar clamp to contact the trailing edge portion of the stacking portion before the leading edge portion of the stacking portion when the driven arm is driven in the first direction.

6. The system of claim 1, comprising:

a second bar clamp extending longitudinally in the direction of transport of the print media, wherein the bar clamp and the second bar clamp are positioned on opposing sides of the stacking portion, wherein the driven arm is coupled to the first portion of the bar clamp through a first cross bar, the first cross bar being further coupled to a first portion of the second bar clamp, and wherein the passive arm is coupled to the second portion of the bar clamp through a second cross bar, the second cross bar being further coupled to a second portion of the second bar clamp.

7. A system to stack print media, comprising:

a bar clamp;

a first arm coupled to a first position on the bar clamp, the first arm being driven by a drive mechanism to selectively extend or retract the first arm relative to a frame;

a second arm coupled to the frame and to a second position on the bar clamp, the second arm to substantially follow movement of the first arm through movement of the bar clamp; and a lost motion mechanism coupling the second arm to the frame.

8. The system of claim 7, wherein the lost motion mechanism includes a resilient member to bias the second arm to be more extended than the first arm.

9. The system of claim 7, further comprising:

a second bar clamp extending parallel to the bar clamp, wherein the first arm is coupled to the first portion of the bar clamp through a first cross bar, the first cross bar being further coupled to a first portion of the second bar clamp, and wherein the second arm is coupled to the second portion of the bar clamp through a second cross bar, the second cross bar being further coupled to a second portion of the second bar clamp.

10. A method for stacking print media, comprising:

detecting an incoming print medium being transported to a stacking portion;

actuating a drive mechanism coupled to a bar clamp arrangement to retract the bar clamp arrangement away from the stacking portion, the bar clamp arrangement including a bar clamp extending in a longitudinal direction parallel to a direction of transport of the incoming print medium;

detecting completion of transport of the incoming print medium to the stacking portion; and actuating the drive mechanism to extend the bar clamp arrangement toward the stacking portion, wherein the driver arrangement comprises:

a driven arm coupled to a first portion of the bar clamp;

a passive arm coupled to a second portion of the bar clamp; and a driver to drive the driven arm in a first direction to extend the bar clamp and in a second direction to retract the bar clamp, the passive arm to follow movement of the driven arm through movement of the bar clamp.

11. The method of claim 10, wherein the bar clamp extends substantially from a leading edge portion of the stacking portion to substantially a trailing edge portion of the stacking portion.

12. The method of claim 10, wherein the drive mechanism comprises:

a lost motion arrangement coupled to the passive arm, the lost motion arrangement biasing the passive arm in the first direction.

13. The method of claim 10, wherein the bar clamp arrangement comprises:

a second bar clamp extending in a longitudinal direction, wherein the bar clamp and the second bar clamp are positioned on opposing sides of the stacking portion, wherein the driven arm is coupled to the first portion of the bar clamp through a first cross bar, the first cross bar being further coupled to a first portion of the second bar clamp, and wherein the passive arm is coupled to the second portion of the bar clamp through a second cross bar, the second cross bar being further coupled to a second portion of the second bar clamp.

* * * * *